US010586497B2

(12) United States Patent
Jang et al.

(10) Patent No.: US 10,586,497 B2
(45) Date of Patent: Mar. 10, 2020

(54) GATE DRIVER AND IMAGE DISPLAY DEVICE INCLUDING THE SAME

(71) Applicant: LG DISPLAY CO., LTD., Seoul (KR)

(72) Inventors: Yong-Ho Jang, Goyang-si (KR); Binn Kim, Seoul (KR); Hae-Yeol Kim, Goyang-si (KR); Bu-Yeol Lee, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 605 days.

(21) Appl. No.: 13/727,251

(22) Filed: Dec. 26, 2012

(65) Prior Publication Data

US 2013/0235004 A1 Sep. 12, 2013

(30) Foreign Application Priority Data

Mar. 8, 2012 (KR) ..... 10-2012-0024022

(51) Int. Cl.
*G09G 3/3275* (2016.01)
*G09G 3/3266* (2016.01)

(52) U.S. Cl.
CPC ..... *G09G 3/3275* (2013.01); *G09G 3/3266* (2013.01)

(58) Field of Classification Search
CPC ..... G09G 2310/0286; G09G 3/296; G09G 3/3266; G09G 3/3611; G09G 3/3648; G09G 3/3659; G09G 3/3674; G09G 3/3677
USPC ..... 345/100, 78, 204; 377/64–81
See application file for complete search history.

(56) References Cited

U.S. PATENT DOCUMENTS

2006/0139253 A1* 6/2006 Choi et al. ..... 345/76
2006/0145991 A1* 7/2006 Jang et al. ..... 345/94
2008/0036706 A1* 2/2008 Kitazawa ..... G09G 3/3233 345/76

FOREIGN PATENT DOCUMENTS

CN 1797155 A 7/2006
CN 101655642 A 2/2010
KR 10-2006-0078492 A 7/2006
KR 10-2008-0035086 A 4/2008

OTHER PUBLICATIONS

Office Action dated Mar. 28, 2016 for Chinese Patent Application No. 201210551612.0, 18 pages.
Office Action dated Jul. 27, 2015 for corresponding Chinese Patent Application No. 201210551612.0, 17 pages.

* cited by examiner

*Primary Examiner* — Hang Lin
(74) *Attorney, Agent, or Firm* — Seed Intellectual Property Law Group LLP

(57) ABSTRACT

A gate driver includes a plurality of driving units each including a first sub driving unit and a second sub driving unit, wherein output terminals of the first and second sub driving units are connected to first and second sub gate lines, respectively, and first and second sub outputs that are the outputs of the first and second sub driving units are respectively transferred to gate terminals of a first switching transistor and a second switching transistor formed in a pixel area of a display area, and wherein drain and source terminals of the first switching transistor are respectively connected to drain and source terminals of the second switching transistors.

11 Claims, 8 Drawing Sheets

GATE DRIVER AND IMAGE DISPLAY DEVICE INCLUDING THE SAME

The present application claims the priority benefit of Korean Patent Application No. 10-2012-0024022 filed in the Republic of Korea on Mar. 8, 2012, which are hereby incorporated by reference in their entirety.

BACKGROUND

Field of the Disclosure

The present disclosure relates to a gate driver and an image display device including the same, and more particularly, to a gate driver capable of improving reliability without using a complicated waveform for driving pixels by simplifying the structure of a shift register, and an image display device including the gate driver.

Discussion of the Related Art

Recently, with the development of information society, demands in the display field are increasing in various forms. In order to meet the demands, studies into various slim, light-weighted flat panel displays having low power consumption, for example, a liquid crystal display (LCD), a plasma display panel (PDP), and an electro luminescent display (ELD) have been conducted.

FIG. 1 is a view illustrating a display panel and a gate driver 20 in the related art image display device, and FIG. 2 shows the output waveforms of the gate driver 20.

Referring to FIG. 1, the display panel may include a display area, the gate driver 20, etc., and a plurality of gate lines GL1, GL2, GL3, GL4, . . . and a plurality of data lines DL1, DL2, DL3, . . . may be formed on the display panel such that the gate lines GL1, GL2, GL3, GL4, . . . cross the data lines DL1, DL2, DL3, . . . to define a plurality of pixel areas.

Also, a switching transistor Tr, a storage capacitor C, a pixel circuit block CB, etc. may be formed in each pixel area.

The gate driver 20, which is formed in a gate in panel (GIP) type in the edge portion of the display panel, generates gate signals using a plurality of gate control signals received through a timing controller (not shown) and a level shifter (not shown), and supplies the gate signals to the display area through the plurality of gate lines GL1, GL2, GL3, GL4, . . . .

Here, each gate signal may be a gate start pulse, a gate shift clock, etc.

As shown in FIG. 1, the gate driver 20 may include a plurality of driving units 22A, 22B, 22C, 22D, . . . .

The driving units 22A, 22B, 22C, 22D, . . . may generate the gate signals using the plurality of gate control signals generated by the level shifter from a plurality of control signals transferred from the timing controller, and the gate signals may be supplied to the display area through the gate lines GL1, GL2, GL3, GL4, . . . .

Each gate signal for driving the display panel may be composed of at least one pulse.

That is, each gate signal may be a simple waveform of signal composed of a pulse, or a complicated waveform of signal composed of two or more pulses.

As shown in FIG. 2, a plurality of gate signals Scan1, Scan2, Scan3, Scan4, ScanN are complicated waveforms of signals including a first pulse A and a second pulse B.

The first pulse A and the second pulse B have a first period T1 and a second period T2, respectively, and have different pulse widths.

The first pulse A turns on the switching transistor Tr of the corresponding pixel area, and while the first pulse A is applied, a first data signal may be applied to the pixel area.

At this time, the first period T1 which is the period of the first pulse A, may be 1 frame.

Meanwhile, the second pulse B also turns on the switching transistor Tr of the corresponding pixel area, and while the second pulse B is applied, a second data signal may be applied to the pixel area.

At this time, the second period T2 which is the period of the second pulse B, may be 1 frame×N (N is the number of gate lines).

For example, the second pulse B may be transferred through only one gate line for each frame, and preferably, may be sequentially applied every frame.

In order to stably drive the image display device with the complicated waveforms of gate signals, it is necessary to accurately apply the gate signals.

However, when the complicated waveforms of gate signals are transferred, signal distortion may occur.

Also, in order to generate such complicated waveforms of outputs, a complicated structure of a driving unit (a shift register) is required.

In the case of designing a driving unit using c-Si transistors or poly-Si transistors, a complicated circuit makes no problem since the transistors have high mobility and high reliability, however, in the case of designing a driving unit using a-Si transistors or oxide transistors, no intended waveform of output may be obtained due to low mobility, etc. of the transistors

SUMMARY

A gate driver includes a plurality of driving units each including a first sub driving unit and a second sub driving unit, wherein output terminals of the first and second sub driving units are connected to first and second sub gate lines, respectively, and first and second sub outputs that are the outputs of the first and second sub driving units are respectively transferred to gate terminals of a first switching transistor and a second switching transistor formed in a pixel area of a display area, and wherein drain and source terminals of the first switching transistor are respectively connected to drain and source terminals of the second switching transistors.

In another aspect, an image display device includes a display panel for displaying an image; and a gate driver formed in an edge portion of the display panel, wherein the gate driver comprises a plurality of driving units each including first and second sub driving units, wherein output terminals of the first and second sub driving units are connected to first and second sub gate lines, respectively, and first and second sub outputs that are outputs of the first and second sub driving units are respectively transferred to gate terminals of a first switching transistor and a second switching transistor of a display area, and wherein drain and source terminals of the first switching transistor are respectively connected to drain and source terminals of the second switching transistor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EXEMPLARY EMBODIMENTS

Reference will now be made in detail to the preferred embodiments, examples of which are illustrated in the accompanying drawings.

Figure 1:
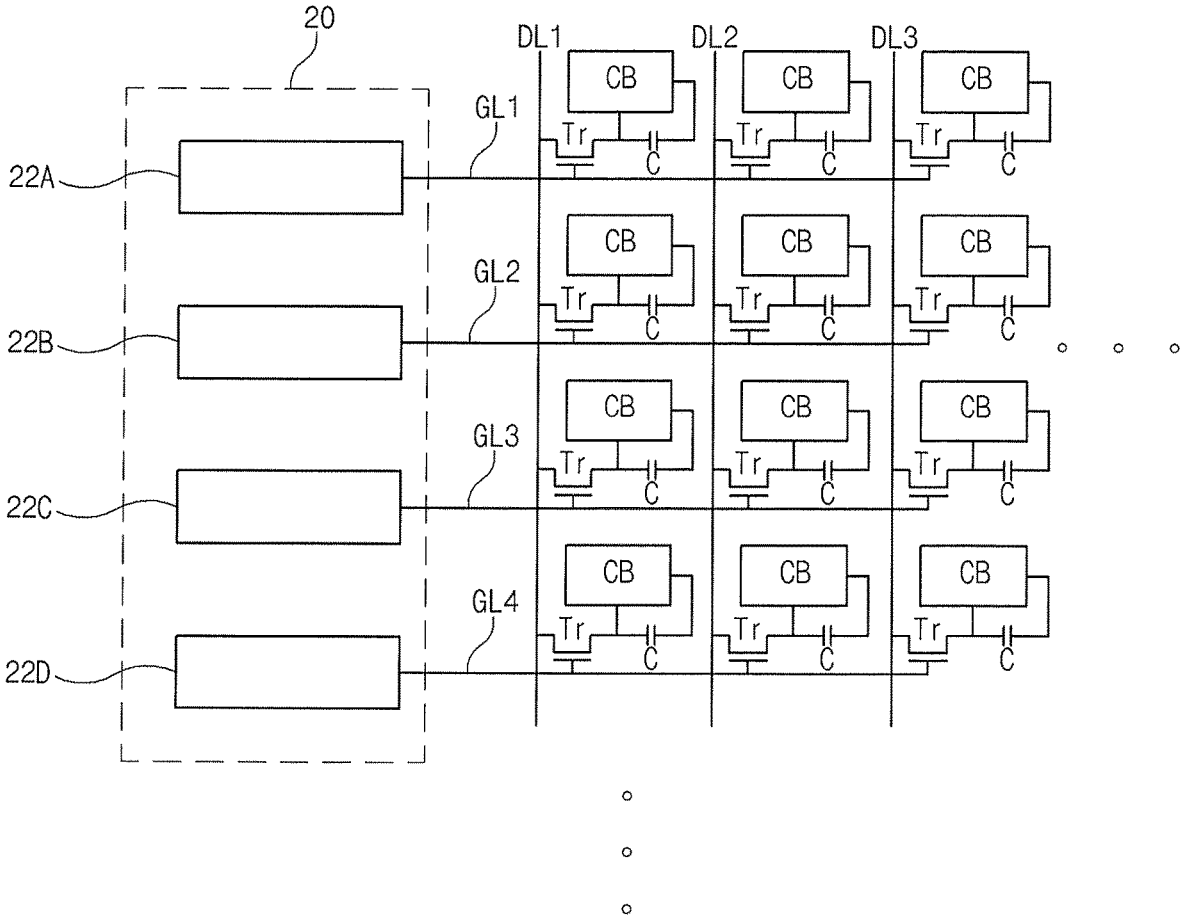
FIG. 1 Related Art
FIG. 1 is a view illustrating a display area and a gate driver in the related art image display device.
Figure 2:
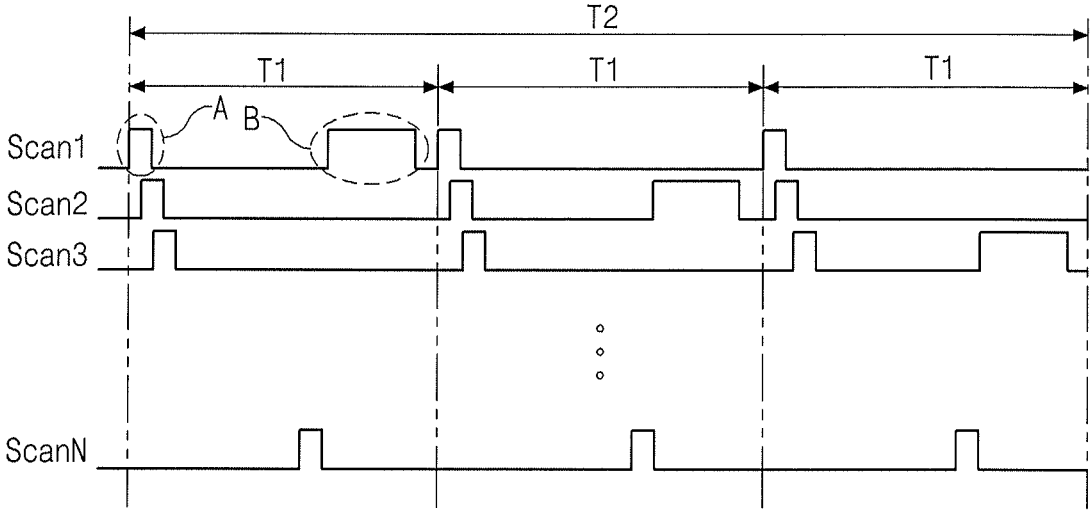
FIG. 2 Related Art
FIG. 2 shows the output waveforms of the gate driver in the related art image display device.
Figure 3:
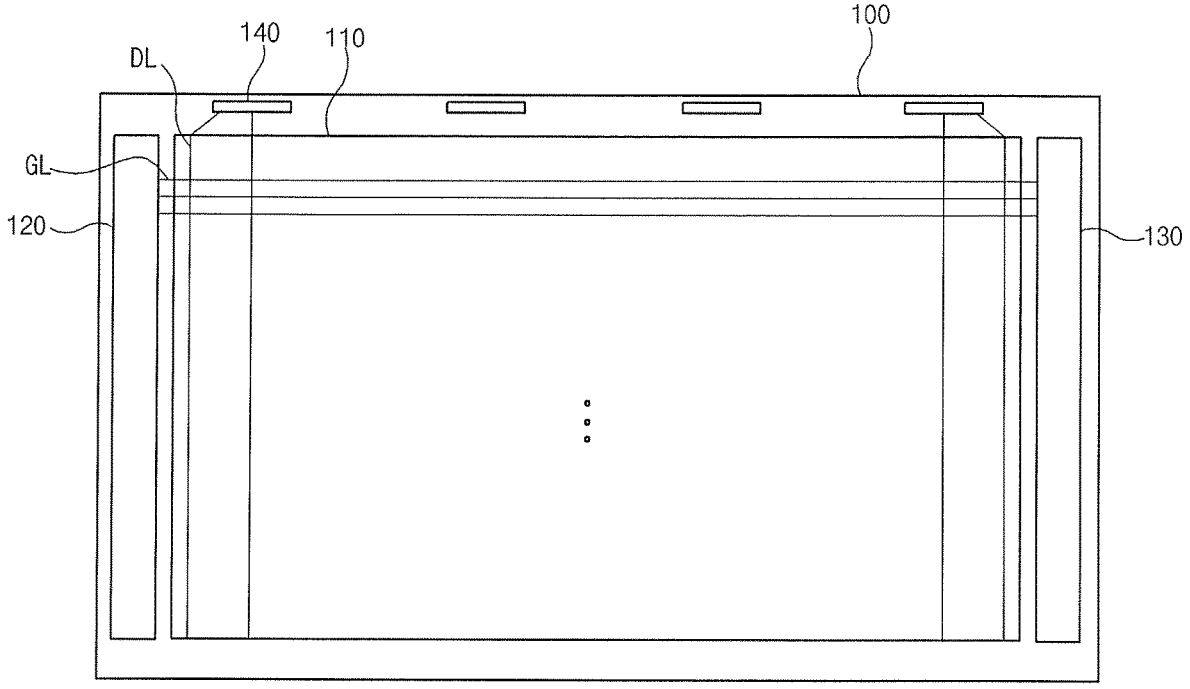
FIG. 3 schematically shows an image display device according to an embodiment of the present invention.
Figure 4:
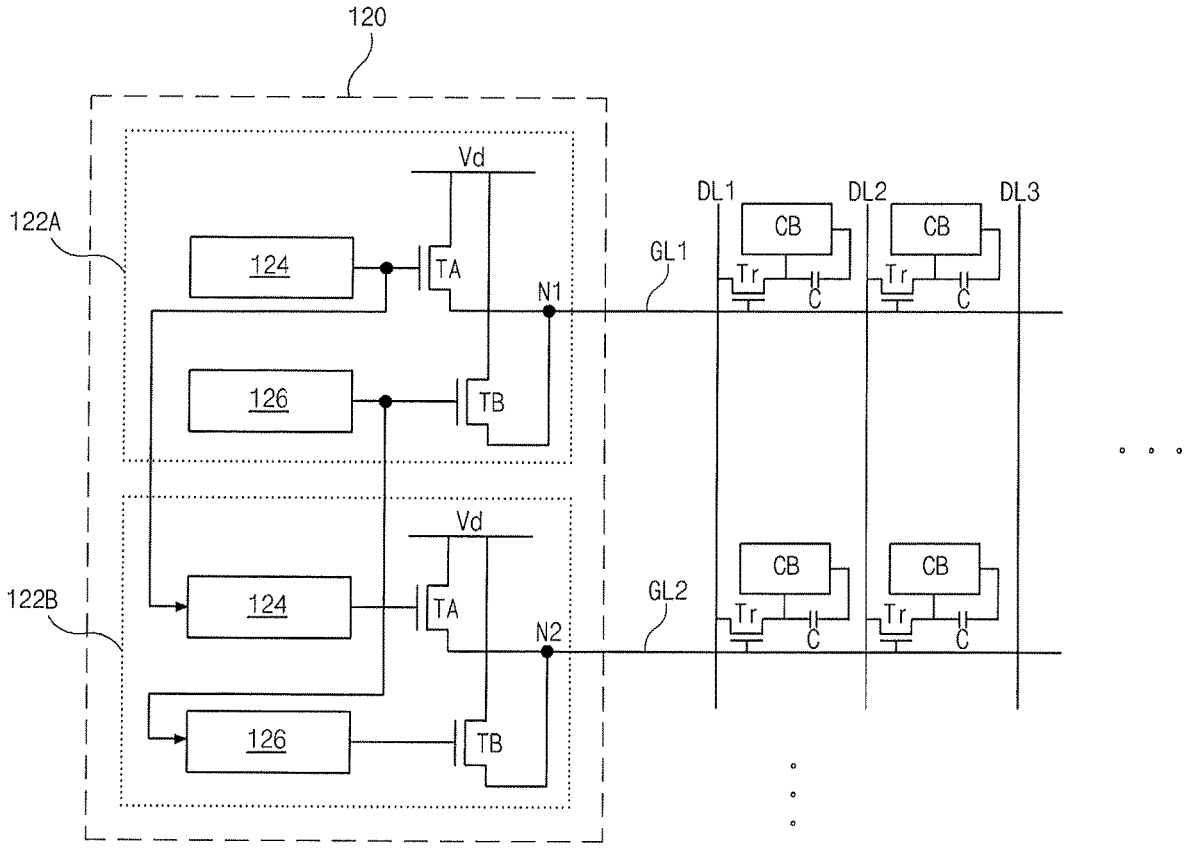
FIG. 4 is a view schematically illustrating a display area and a gate driver in an image display device according to a first embodiment of the present invention.

FIG. 3 schematically shows an image display device according to an embodiment of the present invention, and FIG. 4 is a view schematically illustrating a display area and a gate driver in an image display device according to a first embodiment of the present invention.

The following description relates to an example in which gate drivers are formed in a gate in panel (GIP) type on both edge portions of a display panel, however, it is also possible that a gate driver is formed on an edge portion of a display panel.

Also, the following description relates to an example in which both first and second sub driving units are installed in a display panel, however, it is also possible that at least one of sub driving units is included in an external IC.

Also, the following description relates to an example in which the image display device is an organic light-emitting diode (OLED) display, however, the image display device may be another kind of flat panel display.

As shown in FIG. 3, the image display device includes a display panel 100 for displaying images thereon, a source driver (not shown), a timing controller (not shown), etc.

The display panel 100 may include a display area 110, a left gate driver 120, a right gate driver, 130, etc.

A plurality of gate lines GL1, GL2, . . . and a plurality of data lines DL1, DL2, DL3, . . . that cross each other to define a plurality of pixel areas may be formed on the display area 110.

Also, a switching transistor Tr, a storage capacitor C, a pixel circuit block CB, etc. may be formed in each pixel area.

The pixel circuit block CB may include a plurality of transistors, etc. for driving a sub pixel area.

When the pixel areas of the image display device are driven, gate signals are supplied through the gate lines GL1, GL2, . . . to turn on the switching transistors Tr, and data signals supplied through the data lines DL1, DL2, and DL3 . . . are transferred to the switching transistors Tr and the storage capacitors C.

Then, driving transistors (not shown) are turned on by the data signals, and current flows through the OLEDs so that the OLEDs emit light.

At this time, the intensity of light emitted by each OLED is proportional to the amount of current flowing through the OLED, and the amount of current flowing through the OLED is proportional to the magnitude of the corresponding data signal.

Accordingly, the image display device may represent different gray scales by applying different magnitudes of data signals to the individual pixel areas, thereby displaying the resultant image.

Also, each storage capacitor C maintains a data signal for 1 frame to maintain the amount of current flowing through the corresponding OLED constant, thereby maintaining a gray scale represented by the OLED constant.

The source driver (not shown) includes a plurality of source driver ICs, generates data signals using converted image data and a plurality of data control signals received from the timing controller, and supplies the data signals to the display area 110.

The data signals are transferred to a plurality of source IC pad units 140 formed on the display panel 100, and the source IC pad units 140 supply the data signals to the display area 110 through the data lines DL1, DL2, DL3, . . . .

The left gate driver 120 and the right gate driver 130 are formed in the GIP type on both the edge portions of the display panel 100, generate gate signals using a plurality of gate control signals received through the timing controller and the level shifter, and supply the gate signals to the display area 110 through the gate lines GL1, GL2, . . . .

Each gate control signal may include a gate start pulse, a gate shift clock, etc.

The timing controller may receive a plurality of image signals, and a plurality of control signals, such as a vertical synchronization signal Vsync, a horizontal synchronization signal Hsync, a data enable signal DE, etc., from a system such as a graphic card, through a low voltage differential signal (LVDS) interface.

Also, the timing controller may generate gate control signals for controlling the left gate driver 120 and the right gate driver 130, and data control signals for controlling the source driver, using the plurality of control signals.

Although not shown in the drawings, a power supply unit (not shown) for generating driving voltages for driving the components of the image display device using a supply voltage received from an external device, and supplying the driving voltages, may be further provided.

As shown in FIG. 4, the left gate driver 120 according to the first embodiment of the present invention may include a plurality of driving units 122A, 122B, . . . .

The driving units 122A, 122B, . . . may generate gate signals using the plurality of gate control signals received from the timing controller.

Each gate control signal may include a gate start pulse, a gate shift clock, etc.

The gate signals generated by the driving units 122A, 122B, . . . may be supplied to the display area through the plurality of gate lines GL1, GL2, . . . .

Each of the driving units 122A, 122B, . . . may include a first sub driving unit 124, a second sub driving unit 126, etc.

The first and second sub driving units 124 and 126 may output different pulses.

Also, the outputs of the first and second sub driving units 124 and 126 may be input to the gate terminals of first and second transistors TA and TB, respectively.

The first and second transistors TA and TB of the first driving unit 122A are turned on by the outputs of the first and second sub driving units 124 and 126, and transfer a driving voltage Vd to a first output node N1 while the first and second transistors TA and TB are turned on.

Also, the first and second transistors TA and TB of the second driving unit 122B are turned on by the outputs of the first and second sub driving units 124 and 126, and transfer the driving voltage Vd to a second output node N2 while the first and second transistors TA and TB are turned on.

As a result, the outputs of the first and second sub driving units 124 and 126 are transferred to the output nodes N1, N2, . . . , at different times, and each of gate signals that are transferred through the gate lines GL1, GL2, . . . has a complicated waveform into which two pulses are combined.

As shown in FIG. 4, the outputs of the first and second sub driving units 124 and 126 are respectively input to the input terminals of the next first and second sub driving units 124 and 126 so as to control the outputs of the next first and second sub driving units 124 and 126.

Although not shown in FIG. 4, a plurality of clock signals may be transferred to the sub driving units 124 and 126 in order to control driving of the sub driving units 124 and 126.

The driving units 122A, 122B, . . . , the first sub driving units 124, and the second sub driving units 126 may be shift registers.

That is, the gate driver 120 according to the first embodiment of the present invention includes two sub driving units in each driving unit in order to output a complicated waveform of gate signal into which two pulses are combined, and multiplexes the outputs of the two sub driving units, and supplies the results of the multiplexing to the display area through the gate lines GL1, GL2, . . . .

Figure 5A:
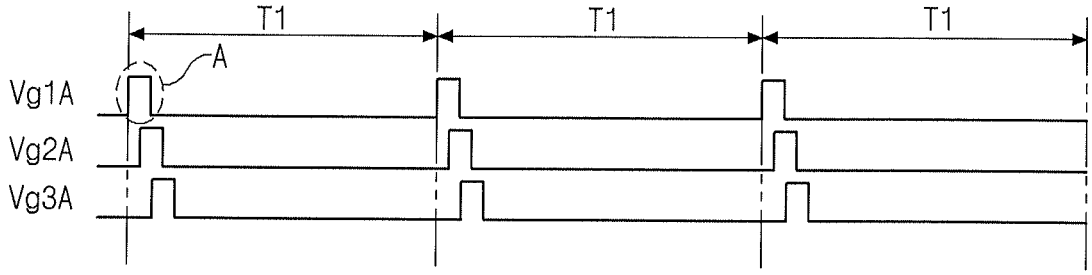
FIGS. 5A and 5B show the waveforms of the first and second sub outputs of the gate driver according to the first embodiment of the present invention.
Figure 5B:
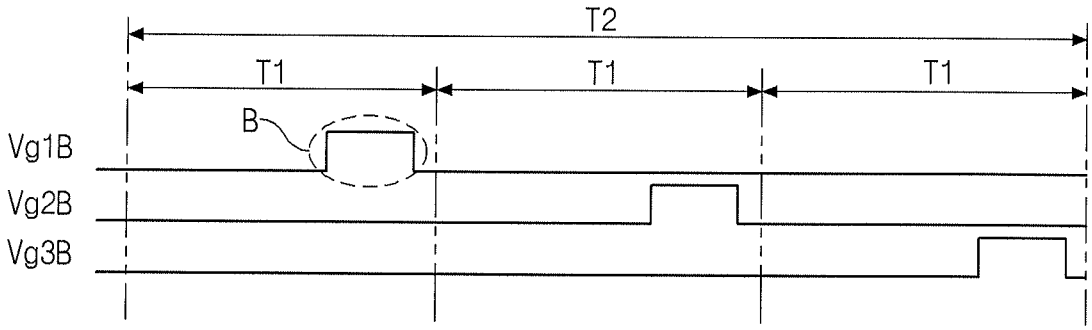

FIGS. 5A and 5B show the waveforms of the first and second sub outputs of the gate driver 120 according to the first embodiment of the present invention. The following description will be given with reference to FIGS. 4, 5A, and 5B.

A gate signal is a complicated waveform of signal including a first pulse A and a second pulse B having different periods.

As shown in FIG. 5A, each of the first sub outputs Vg1A, Vg2A, Vg3A, . . . of the first sub driving units 124 is composed of a first pulse A that is applied every first period T1.

The first pulse A turns on the switching transistor Tr of the corresponding pixel area, and a first data signal may be applied to the pixel area while the first pulse A is applied.

The first period T1, which is the period of the first pulse A, may be 1 frame.

As shown in FIG. 5B, each of the second sub outputs Vg1B, Vg2B, Vg3B, . . . of the second sub driving units 126 is composed of a second pulse B that is applied every second period T2.

The second pulse B turns on the switching transistor Tr of the corresponding pixel area, and a second data signal may be applied to the pixel area while the second pulse B is applied.

The second period T2 which is the period of the second pulse B may be 1 frame×N (N is the number of gate lines).

For example, the second pulse B may be transferred through only a gate line for each frame, and may be sequentially applied every 1 frame.

The gate driver 20 according to the first embodiment of the present invention includes two sub driving units in each driving unit, and multiplexes the first and second sub outputs of the two sub driving units, and supplies the results of the multiplexing to the display area through the gate lines GL1, GL2, . . . .

In the case of designing a driving unit using c-Si transistors or poly-Si transistors, the image display device causes no problem upon driving although the driving unit includes two sub driving units and first and second transistors TA and TB, since the transistors have high mobility and high reliability.

However, in the case of designing a driving unit using a-Si transistors or oxide transistors, the image display device may cause a problem upon driving since no intended waveform of output may be obtained due to relatively low mobility, etc. of the transistors.

In this case, applying a higher voltage to the switching transistor of the pixel area for outputting an intended waveform of output increases resistance of the switching transistor, which inevitably increases the sizes of the first and second transistors TA and TB in order to adjust the resistance of the switching transistor to a constant value.

Also, due to the first and second transistors TA and TB, a voltage reduced by the threshold voltages Vth of the first and second transistors TA and TB from the driving voltage Vd is transferred to the output nodes, which may influence the driving of the image display device.

Figure 6:
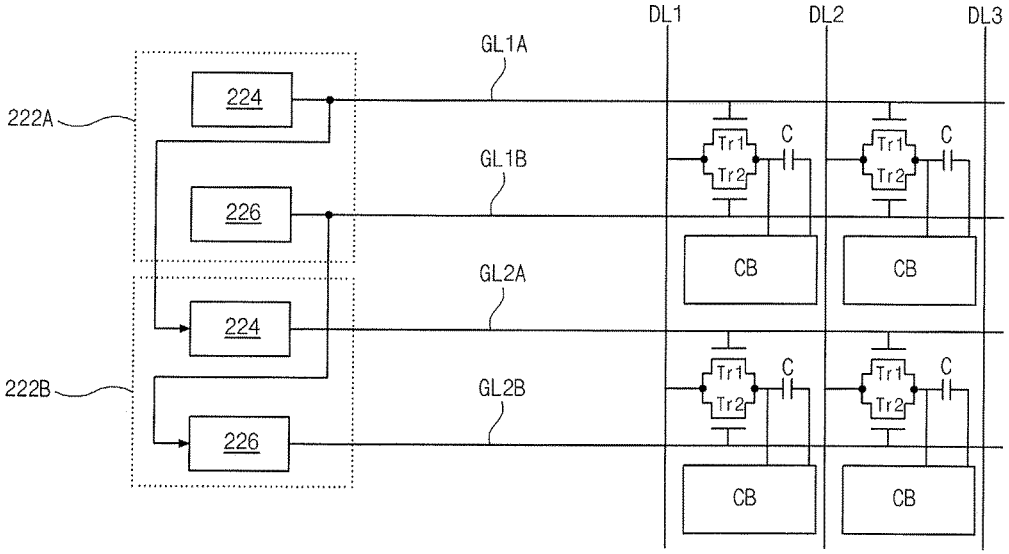
FIG. 6 is a view schematically illustrating a display area and a gate driver in an image display device according to a second embodiment of the present invention.

FIG. 6 is a view schematically illustrating a display area and a gate driver in an image display device according to a second embodiment of the present invention. The following description will be given with reference to FIGS. 5A, 5B, and 6, As shown in FIG. 6, first sub gate lines GL1A, GL2A, . . . , second sub gate lines GL1B, GL2B, . . . , and data lines DL1, DL2, DL3, . . . may be formed on the display area of the image display device according to the second embodiment of the present invention.

The first sub gate lines GL1A, GL2A, . . . and the data lines DL1, DL2, DL3, may cross each other to define a plurality of pixel areas.

In each pixel area, a first switching transistor Tr1, a second switching transistor Tr2, a storage capacitor C, a pixel circuit block CB, etc. may be formed.

Here, the first switching transistor Tr1 is connected in parallel to the second switching transistor Tr2, such that the source terminal of the first switching transistor Tr1 is connected to the source terminal of the second switching transistor Tr2, and the drain terminal of the first switching transistor Tr1 is connected to the drain terminal of the second switching transistor Tr2.

Also, the drain terminals of the first and second switching transistors Tr1 and Tr2 are connected to one electrode of the storage capacitor C.

Also, each pixel circuit block CB may be configured with a plurality of transistors, etc. for driving a sub pixel area.

The first and second switching transistors Tr1 and Tr2 operate by receiving the outputs of the first and second sub driving units 224 and 226, and the first and second switching transistors Tr1 and Tr2 may be oxide transistors.

For example, the first and second switching transistors Tr1 and Tr2 are turned on by the outputs of the first and second sub driving units 224 and 226, and transfer first and second data signals applied through the data lines DL1, DL2, DL3, . . . , while the first and second switching transistors Tr1 and Tr2 are turned on.

As such, the left gate driver 120 according to the second embodiment of the present invention may include a plurality of driving units 222A, 222B, . . . .

The driving units 222A, 222B, . . . may generate gate signals using a plurality of gate control signals received from the timing controller.

Also, first sub outputs Vg1A, Vg2A, Vg3A, . . . and second sub outputs Vg1B, Vg2B, Vg3B, . . . , generated by the plurality of driving units 222A, 222B, . . . may be supplied to the display area through the first sub gate lines GL1A, GL2A, . . . and the second sub gate lines GL1B, GL2B, . . . .

That is, the image display device according to the second embodiment of the present invention includes two sub driving units in each driving unit, and supplies the first sub outputs Vg1A, Vg2A, Vg3A, . . . and second sub outputs Vg1B, Vg2B, Vg3B, . . . of the two sub driving units to the display area through the first and second sub gate lines, respectively.

Also, the first and second switching transistors Tr1 and Tr2 are turned on by the first sub outputs Vg1A, Vg2A, Vg3A, . . . and second sub outputs Vg1B, Vg2B, Vg3B, . . . , and first and second data signals are transferred to the display area while the first and second switching transistors Tr1 and Tr2 are turned on.

In the second embodiment of the present invention, the first and second switching transistors Tr1 and Tr2 are formed in each pixel area, and although the first and second switching transistors Tr1 and Tr2 are oxide transistors, it is unnecessary to increase the sizes of the first and second switching transistors Tr1 and Tr2.

Also, with regard to the driving method of the image display device, since the threshold voltages Vth of the first and second switching transistors Tr1 and Tr2 are compensated, the threshold values Vth of the first and second switching transistors Tr1 and Tr2 can be prevented from influencing the driving of the image display device.

Figure 7:
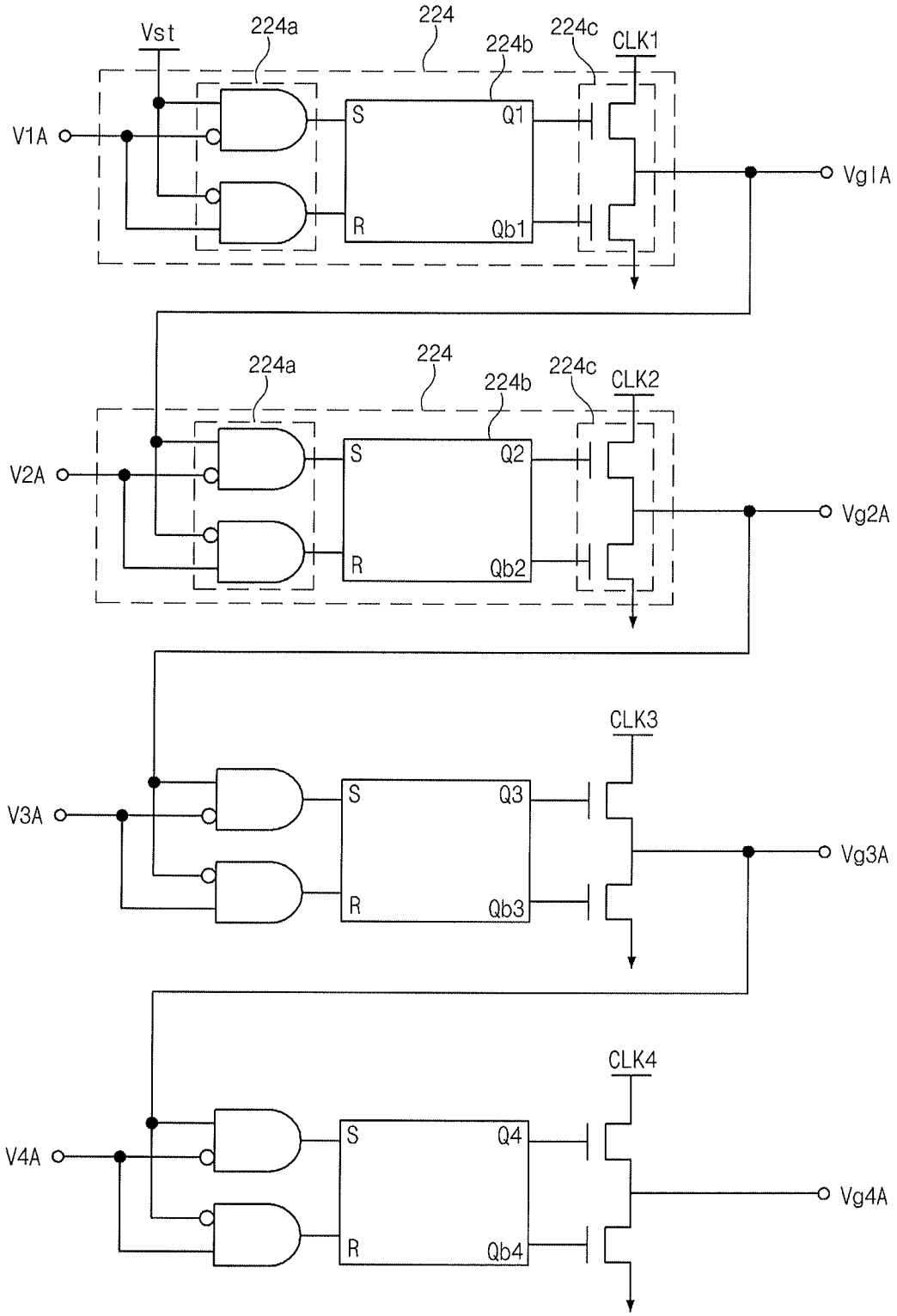
FIG. 7 is a view for explaining the operation of a first sub driving unit of the gate driver according to the second embodiment of the present invention.

FIG. 7 is a view for explaining the operation of a first sub driving unit 224 of the gate driver according to the second embodiment of the present invention.

The following description relates to an example of a circuit in which a sub output is adjusted according to a clock signal. However, an arbitrary circuit that is different from a circuit in which the sub output of at least one of first and second sub driving units is adjusted by a clock signal, can be used.

As shown in FIG. 7, the first sub driving unit 224 includes an input unit 224*a*, a logic unit 224*b*, and an output unit 224*c*.

The input unit 224*a* of the first sub driving unit 224 receives a start signal Vst and a reset signal V1A for controlling the driving of the logic unit 224*b*.

The start signal Vst may be a gate start pulse or the output of a first sub driving unit at the previous stage, and the reset signal V1A may be the output of the next sub driving unit, or the output of the sub driving unit after next.

Also, the logic unit 224*b* outputs Q1 and Qb1 signals according to the start signal Vst and the reset signal V1A, and the output unit 224*c* transfers a first clock signal CLK1 to an output node according to the Q1 and Qb1 signals.

As a result, the first sub output Vg1A of the first sub driving unit 224 has the same waveform as the first clock signal CLK1.

That is, by adjusting the period and pulse width of the first clock signal CLK1, a first sub output Vg1A having an intended waveform may be output.

In more detail, while the Q1 signal representing an enabled state is in a high state, the first sub output Vg1A is generated by the first clock signal CLK1.

The input unit 224*a* of the first sub driving unit 224 at the next stage receives a start signal Vg1A and a reset signal V2A for controlling the driving of the logic unit 224*b*.

The start signal Vg1A may be the output of the previous first sub driving unit.

Also, the logic unit 224*b* outputs the Q1 and Qb1 signals according to the start signal Vg1A and the reset signal V2A, and the output unit 224*c* transfers a second clock signal CLK2 to an output node according to the Q1 and Qb1 signals.

As a result, the first sub output Vg1A has the same waveform as the second clock signal CLK2.

The second clock signal CLK2 may have the same waveform as the first clock signal CLK1. That is, the first and second clock signals CLK1 and CLK2 may be shifted signals having the same pulse width.

In this way, the first sub outputs Vg1A, Vg2A, Vg3A, . . . of the gate driver may be sequentially generated and transferred to the display area, and likewise, the second sub outputs may also be sequentially generated and transferred to the display area.

Figure 8:
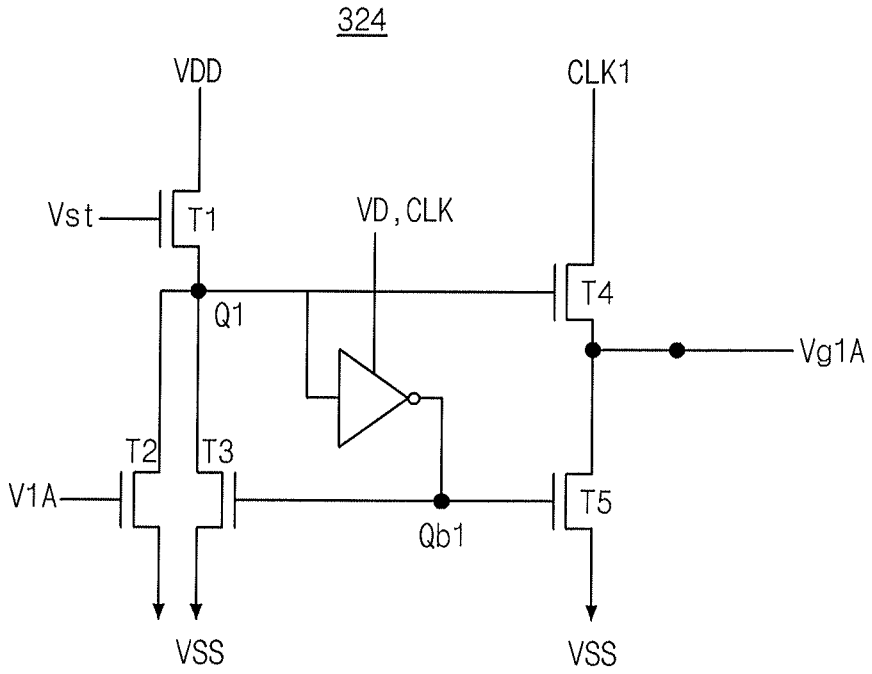
FIG. 8 is a view for explaining the operation of a first sub driving unit of a gate driver according to a third embodiment of the present invention.

FIG. 8 is a view for explaining the operation of a first sub driving unit 324 of a gate driver according to a third embodiment of the present invention.

The following description relates to an example in which a start signal and a reset signal are input to different input terminals of the first sub driving unit 324, however, it is also possible that a start signal and a reset signal are input to the same input terminal of the first sub driving unit 324, and in this case, by receiving the start signal and the reset signal as the outputs of the previous stage, first and second driving voltages are transferred to a Q1 node so that an intended first sub output is output.

As shown in FIG. 8, the first sub driving unit 324 includes first through fifth transistors T1 through T5, an inverter circuit, etc.

The first transistor T1 receives a start signal Vset, and transfers a first driving voltage VDD to a Q1 node.

The start signal Vst may be a gate start pulse or the output of a first sub driving unit at the previous stage, and a reset signal V1A may be the output of the next first sub driving unit or the output of the first sub driving unit after the next first sub driving unit.

The first driving voltage VDD transferred to the Q1 node is inverted by the inverter circuit, and transferred to a Qb1 node.

That is, when the voltage level of the Q1 node is high, the voltage level of the Qb1 node is low, and when the voltage level of the Q1 node is low, the voltage level of the Qb1 node is high.

The Q1 and Qb1 signals act to transfer a first clock signal CLK1 to an output node. The Q1 and Qb1 signals represent voltages at the Q1 and Qb1 nodes.

As a result, the first sub output Vg1A of the first sub driving unit 224 has the same waveform as the first clock signal CLK1.

Second and third transistors T2 and T3 receive a reset signal V1A and a voltage applied at the Qb1 node, and reset the first sub driving unit 324.

That is, the second and third transistors T2 and T3 transfer a second driving voltage VSS to the Q1 node, and control the first sub driving unit 324 such that the first sub output Vg1A of the first sub driving unit 324 is the second driving voltage VSS.

Therefore, as described above, according to the gate driver and the image display device including the same, it is possible to improve reliability without using a complicated waveform for driving pixels by simplifying the structure of a shift register.

It will be apparent to those skilled in the art that various modifications and variations can be made in a display device of the present disclosure without departing from the sprit or scope of the invention. Thus, it is intended that the present invention covers the modifications and variations of this invention provided they come within the scope of the appended claims and their equivalents.

What is claimed is:

1. A gate driver comprising:

a plurality of driving units connected to respective rows of pixels of a display area, each of the driving units including:

a first sub driving unit having an output terminal connected to a first sub gate line of a respective row of pixels, the output terminal of the first sub driving unit supplies a first sub output to gate terminals of first switching transistors in each pixel of the respective row of pixels, and a second sub driving unit having an output terminal connected to a second sub gate line of the respective row of pixels, the output terminal of the second sub driving unit supplies a second sub output to gate terminals of second switching transistors in each pixel of the respective row of pixels, source and drain terminals of the second switching transistors being connected to corresponding source and drain terminals of the first switching transistors in each of the pixels, wherein a first data signal to be displayed is applied to a pixel of the row when the first output of the first sub driving unit is present and a second data signal to be displayed is applied to the pixel when the second output of the second sub driving unit is present, wherein a time when the first switching transistor is turned on by a first pulse of the first sub output in a frame does not overlap a time when the second switching transistor is turned on by the second sub output in the frame, wherein the output of the first sub driving unit is present every frame, and the output of the second sub driving unit is present every N frames (where N is a number of second sub gate lines), wherein each of the first and second sub driving units includes an input unit that receives a start signal and a reset signal that control driving of the first and second sub driving units, and wherein the start signal to the input unit of the first sub driving unit is the output of the first sub-driving unit at a previous stage except for the input unit of the first sub driving unit in a first stage, the same output of the first sub-driving unit is also applied to the gate terminal of the first transistor to turn on the first transistor.

2. The gate driver of claim 1, wherein each of the first and second sub driving units further includes a logic unit that outputs Q and Qb signals according to the start signal and the reset signal.

3. The gate driver of claim 2, wherein each of the first and second sub driving units further includes an output unit that transfers a clock signal to an output node according to the Q and Qb signals.

4. The gate driver of claim 3, wherein the first and second sub outputs are adjusted by a pulse width and a period of the clock signal.

5. The gate driver of claim 1, wherein the output terminal of the first sub driving unit is connected to the first sub gate line of the respective row of pixels at one of opposing sides of the display area, and the output terminal of the second sub driving unit is connected to the second sub gate line of the respective row of pixels at the one of the opposing sides of the display area.

6. An image display device comprising:

a display panel for displaying an image;

a plurality of rows of pixels on the display panel, each of the pixels including a first switching transistor and a second switching transistor, source terminals of the first switching transistors being connected to corresponding source terminals of the second switching transistors in each of the pixels, and drain terminals of the first switching transistors being connected to corresponding drain terminals of the second switching transistors in each of the pixels;

first and second sub gate lines in each of the plurality of rows of pixels, each of the first sub gate lines connected to gate terminals of the first switching transistors of a respective row of pixels, each of the second sub gate lines connected to gate terminals of the second switching transistors of a respective row of pixels;

a gate driver formed in an edge portion of the display panel, the gate driver including a plurality of driving units, each of the driving units including:

a first sub driving unit having an output terminal connected to a respective first sub gate line, the output terminal of the first sub driving unit supplies a first sub output to the gate terminals of the first switching transistors in each pixel of the respective row of pixels, and a second sub driving unit having an output terminal connected to a respective second sub gate line, the output terminal of the second sub driving unit supplies a second sub output to the gate terminals of the second switching transistors in each pixel of the respective row of pixels, wherein a first data signal to be displayed is applied to a pixel when the first output of the first sub driving unit is present and a second data signal to be displayed is applied to the pixel when the second output of the second sub driving unit is present, wherein the output of the first sub driving unit is present every frame, and the output of the second sub driving unit is present every N frames (where N is a number of second sub gate lines), wherein a time when the first switching transistor is turned on by a first pulse of the first sub output in a frame does not overlap a time when the second switching transistor is turned on by a second pulse of the second sub output in the frame, wherein each of the first and second sub driving units includes an input unit that receives a start signal and a reset signal that control driving of the first and second sub driving units, and wherein the start signal to the input unit of the first sub driving unit is the output of the first sub-driving unit at a previous stage except for the input unit of the first sub driving unit in a first stage, the same output of the first sub-driving unit is also applied to the gate terminal of the first transistor to turn on the first transistor.

7. The device of claim 6, wherein a display area including the first sub gate lines, the second sub gate lines, and a plurality of data lines is formed on the display panel, wherein the first sub gate lines and the data lines cross each other to define respective pixel areas on the display area, and wherein the first and second switching transistors that are driven by the first and second sub outputs are formed in the respective pixel areas.

8. The device of claim 6, wherein each of the first and second sub driving units further includes a logic unit that outputs Q and Qb signals according to the start signal and the reset signal.

9. The device of claim 8, wherein each of the first and second sub driving units further includes an output unit that transfers a clock signal to an output node according to the Q and Qb signals.

10. The device of claim 9, wherein the first and second sub outputs are adjusted according to a pulse width and a period of the clock signal.

11. The device of claim 6, wherein the output terminal of the first sub driving unit is connected to the first sub gate line of the respective row of pixels at one of opposing sides of the display area, and the output terminal of the second sub driving unit is connected to the second sub gate line of the respective row of pixels at the one of the opposing sides of the display area.

* * * * *